US006827750B2

(12) United States Patent
Drozd et al.

(10) Patent No.: US 6,827,750 B2
(45) Date of Patent: Dec. 7, 2004

(54) CONTROLLED RELEASE ADDITIVES IN FUEL SYSTEMS

(75) Inventors: Joseph C. Drozd, Park Ridge, IL (US); Harold R. Martin, Cookeville, TN (US); Thomas J. Blakemore, Flossmoor, IL (US); Dennis Kelly, Chicago, IL (US); Doug Hudgens, Cookeville, TN (US)

(73) Assignees: Dober Chemical Corp, Midlothian, IL (US); Fleetguard, Inc., Nashville, TN (US)

( * ) Notice: Subject to any disclaimer, the term of this patent is extended or adjusted under 35 U.S.C. 154(b) by 56 days.

(21) Appl. No.: 09/939,212

(22) Filed: Aug. 24, 2001

(65) Prior Publication Data

US 2004/0026291 A1 Feb. 12, 2004

(51) Int. Cl.[7] ..... C10L 1/00

(52) U.S. Cl. ..... 44/629; 44/639; 123/1 A; 123/464; 210/109; 210/149; 210/192; 210/206; 210/209; 422/110; 422/264; 422/270

(58) Field of Search ..... 44/629, 639, 309, 44/329, 397, 300, 500, 530, 542, 544; 123/1 A, 464; 210/109, 149, 192, 206, 209; 422/110, 264, 270, 261, 203; 428/407

(56) References Cited

U.S. PATENT DOCUMENTS

| | | | | |
|---|---|---|---|---|
| 2,280,792 A | | 4/1942 | Bruson | |
| 2,754,330 A | | 7/1956 | Schreyer | |
| 2,782,240 A | | 2/1957 | Hefner et al. | |
| 2,841,479 A | | 7/1958 | Hefner et al. | |
| 2,928,877 A | | 3/1960 | Jaul et al. | |
| 2,955,028 A | * | 10/1960 | Bevans | 137/268 |
| 3,087,436 A | | 4/1963 | Dettlof et al. | |
| 3,172,892 A | | 3/1965 | Le Suer et al. | |
| 3,215,707 A | | 11/1965 | Rense | |
| 3,231,587 A | | 1/1966 | Rense | |
| 3,272,746 A | | 9/1966 | Le Suer et al. | |
| 3,275,554 A | | 9/1966 | Wagenaar | |
| 3,336,223 A | | 8/1967 | Kneeland | |
| 3,361,673 A | | 1/1968 | Stuart et al. | |
| 3,368,972 A | | 2/1968 | Otto | |
| 3,413,347 A | | 11/1968 | Worrel | |
| 3,422,157 A | | 1/1969 | Kaufman et al. | |
| 3,438,757 A | | 4/1969 | Honnen et al. | |
| 3,440,029 A | | 4/1969 | Little et al. | |
| 3,454,555 A | | 7/1969 | van der Voort et al. | |

(List continued on next page.)

FOREIGN PATENT DOCUMENTS

| | | |
|---|---|---|
| EP | 0279863 | 8/1988 |
| EP | 0448365 | 9/1991 |
| EP | 0476485 | 3/1992 |
| EP | 0516838 | 12/1992 |
| EP | 0573578 | 12/1993 |

OTHER PUBLICATIONS

Drozd et al., application Ser. No. 09/939,196, filed Aug. 24, 2001 (Docket #D–2874).

Kelly et al., application Ser. No. 09/939,214, filed Aug. 24, 2001 (Docket #D–2920).

Martin et al., application Ser. No. 09/939,542, filed Aug. 24, 2001 (Docket #D–2959CIP).

*Primary Examiner*—Margaret B. Medley
(74) *Attorney, Agent, or Firm*—Stout, Uxa, Buyan & Mullins, LLP; Frank J. Uxa

(57) ABSTRACT

A container for releasing a chemical additive into a fuel composition comprises a fuel-impermeable casing having a hollow interior and an additive composition comprising at least one fuel soluble additive. The additive is held within the container by at least one fuel-permeable element provided at or near an opening in the casing and is effective to provide for release of additive(s) into the fuel composition. Methods of releasing additives into fuel compositions are also provided.

46 Claims, 5 Drawing Sheets

U.S. PATENT DOCUMENTS

| | | | | | |
|---|---|---|---|---|---|
| 3,454,607 | A | | 7/1969 | Le Suer et al. | |
| 3,565,804 | A | | 2/1971 | Honnen et al. | |
| 3,574,576 | A | | 4/1971 | Honnen et al. | |
| 3,598,738 | A | | 8/1971 | Biswell et al. | |
| 3,649,229 | A | | 3/1972 | Otto | |
| 3,671,511 | A | | 6/1972 | Honnen et al. | |
| 3,697,574 | A | | 10/1972 | Piasek et al. | |
| 3,715,037 | A | | 2/1973 | Shin-En Hu | |
| 3,725,277 | A | | 4/1973 | Worrel | |
| 3,726,882 | A | | 4/1973 | Traise et al. | |
| 3,749,247 | A | | 7/1973 | Rohde | |
| 3,755,433 | A | | 8/1973 | Miller et al. | |
| 3,756,793 | A | | 9/1973 | Robinson | |
| 3,790,357 | A | | 2/1974 | Feldman | |
| 3,822,289 | A | | 7/1974 | Clark et al. | |
| 3,849,085 | A | | 11/1974 | Kreuz et al. | |
| 3,877,899 | A | | 4/1975 | Bundy et al. | |
| 3,880,569 | A | * | 4/1975 | Bannister et al. | 431/4 |
| 3,912,764 | A | | 10/1975 | Palmer, Jr. | |
| 3,932,537 | A | | 1/1976 | Wetzel et al. | |
| 3,954,808 | A | | 5/1976 | Elliott et al. | |
| 3,977,992 | A | | 8/1976 | Hofacker | |
| 3,980,589 | A | | 9/1976 | Murrell et al. | |
| 3,999,960 | A | | 12/1976 | Langer, Jr. et al. | |
| 4,026,809 | A | | 5/1977 | Lachowicz et al. | |
| 4,032,700 | A | | 6/1977 | Song et al. | |
| 4,066,559 | A | | 1/1978 | Rohde | |
| 4,075,097 | A | | 2/1978 | Paul | |
| 4,075,098 | A | | 2/1978 | Paul et al. | |
| 4,110,349 | A | | 8/1978 | Cohen | |
| 4,125,382 | A | | 11/1978 | O'Brien et al. | |
| 4,129,421 | A | * | 12/1978 | Webb | 44/354 |
| 4,137,185 | A | | 1/1979 | Gardiner et al. | |
| 4,156,061 | A | | 5/1979 | Pappas et al. | |
| 4,214,994 | A | | 7/1980 | Kitano | |
| 4,222,746 | A | | 9/1980 | Sweeney et al. | |
| 4,231,759 | A | | 11/1980 | Udelhofen et al. | |
| 4,234,435 | A | | 11/1980 | Meinhardt et al. | |
| 4,238,628 | A | | 12/1980 | Cahill et al. | |
| 4,247,301 | A | | 1/1981 | Honnen | |
| 4,261,704 | A | | 4/1981 | Langdon | |
| 4,265,748 | A | | 5/1981 | Villani et al. | |
| 4,294,586 | A | | 10/1981 | Cox, Jr. | |
| 4,320,019 | A | | 3/1982 | Hayashi | |
| 4,323,714 | A | | 4/1982 | Malloy et al. | |
| 4,326,972 | A | | 4/1982 | Chamberlin, III | |
| 4,357,250 | A | | 11/1982 | Hayashi | |
| 4,365,973 | A | * | 12/1982 | Irish | 44/326 |
| 4,379,065 | A | | 4/1983 | Lange | |
| 4,460,379 | A | | 7/1984 | Sweeney et al. | |
| 4,469,908 | A | | 9/1984 | Burress | |
| 4,515,740 | A | * | 5/1985 | Schuettenberg et al. | 264/50 |
| 4,561,981 | A | | 12/1985 | Characklis | |
| 4,588,640 | A | * | 5/1986 | Matlach | 428/407 |
| 4,639,255 | A | | 1/1987 | Schuettenberg et al. | |
| 4,658,078 | A | | 4/1987 | Slaugh et al. | |
| 4,659,334 | A | * | 4/1987 | Matlach | 44/346 |
| 4,663,063 | A | | 5/1987 | Davis | |
| 4,668,834 | A | | 5/1987 | Rim et al. | |
| 4,673,527 | A | | 6/1987 | Goudy, Jr. et al. | |
| 4,708,809 | A | | 11/1987 | Davis | |
| 4,717,495 | A | | 1/1988 | Hercamp et al. | |
| 4,728,452 | A | | 3/1988 | Hansen | |
| 4,740,321 | A | | 4/1988 | Davis et al. | |
| 4,755,189 | A | | 7/1988 | Feldman | |
| 4,756,844 | A | | 7/1988 | Walles et al. | |
| 4,849,569 | A | | 7/1989 | Smith, Jr. | |
| 4,857,073 | A | | 8/1989 | Vataru et al. | |
| 4,862,908 | A | | 9/1989 | Payer | |
| 4,892,562 | A | | 1/1990 | Bowers et al. | |
| 4,904,401 | A | | 2/1990 | Ripple et al. | |
| 4,937,299 | A | | 6/1990 | Ewen et al. | |
| 4,980,075 | A | | 12/1990 | Dobrez et al. | |
| 4,981,602 | A | | 1/1991 | Ripple et al. | |
| 5,019,669 | A | | 5/1991 | Adams et al. | |
| 5,032,259 | A | | 7/1991 | He et al. | |
| 5,050,549 | A | | 9/1991 | Sturmon | |
| 5,053,152 | A | | 10/1991 | Steckel | |
| 5,059,217 | A | | 10/1991 | Arroyo et al. | |
| 5,071,919 | A | | 12/1991 | DeGonia et al. | |
| 5,089,041 | A | | 2/1992 | Thompson et al. | |
| 5,094,666 | A | | 3/1992 | Feldman et al. | |
| 5,120,349 | A | | 6/1992 | Stewart et al. | |
| 5,137,978 | A | | 8/1992 | Degonia et al. | |
| 5,137,988 | A | | 8/1992 | Matzner et al. | |
| 5,160,648 | A | | 11/1992 | Steckel | |
| 5,186,732 | A | | 2/1993 | Thompson et al. | |
| 5,192,335 | A | | 3/1993 | Cherpeck | |
| 5,230,714 | A | | 7/1993 | Steckel | |
| 5,235,936 | A | * | 8/1993 | Kracklauer | 123/1 A |
| 5,249,552 | A | | 10/1993 | Brooks | |
| 5,286,823 | A | | 2/1994 | Rath | |
| 5,296,154 | A | | 3/1994 | Steckel | |
| 5,300,701 | A | | 4/1994 | Cherpeck | |
| 5,324,800 | A | | 6/1994 | Welborn, Jr. et al. | |
| 5,332,407 | A | | 7/1994 | Herbstman | |
| 5,336,278 | A | | 8/1994 | Adams et al. | |
| 5,337,705 | A | | 8/1994 | Lane | |
| 5,346,965 | A | | 9/1994 | Dever et al. | |
| 5,368,615 | A | | 11/1994 | Steckel | |
| 5,372,942 | A | | 12/1994 | McGarrity et al. | |
| 5,407,594 | A | | 4/1995 | Fry et al. | |
| 5,408,018 | A | | 4/1995 | Rath | |
| 5,456,217 | A | | 10/1995 | Thunker et al. | |
| 5,458,793 | A | | 10/1995 | Adams et al. | |
| 5,483,327 | A | | 1/1996 | Taya et al. | |
| 5,496,383 | A | | 3/1996 | Franz et al. | |
| 5,507,942 | A | | 4/1996 | Davis | |
| 5,508,356 | A | | 4/1996 | Dever et al. | |
| 5,527,452 | A | | 6/1996 | Grigoriev et al. | |
| 5,565,106 | A | | 10/1996 | Sherbondy et al. | |
| 5,567,845 | A | | 10/1996 | Franz et al. | |
| 5,573,557 | A | | 11/1996 | Thünker et al. | |
| 5,580,359 | A | | 12/1996 | Wright | |
| 5,591,330 | A | | 1/1997 | Lefebvre | |
| 5,620,949 | A | | 4/1997 | Baker et al. | |
| 5,643,351 | A | | 7/1997 | Lew et al. | |
| 5,662,799 | A | | 9/1997 | Hudgens et al. | |
| 5,662,803 | A | | 9/1997 | Young | |
| 5,663,457 | A | | 9/1997 | Kolp | |
| 5,674,950 | A | | 10/1997 | Thaler et al. | |
| 5,691,422 | A | | 11/1997 | Emert et al. | |
| 5,695,531 | A | | 12/1997 | Makino et al. | |
| 5,696,060 | A | | 12/1997 | Baker et al. | |
| 5,696,067 | A | | 12/1997 | Adams et al. | |
| 5,711,894 | A | | 1/1998 | Miyake et al. | |
| 5,718,836 | A | | 2/1998 | Nakatani et al. | |
| 5,739,356 | A | | 4/1998 | Dietz et al. | |
| 5,741,433 | A | | 4/1998 | Mitchell et al. | |
| 5,752,989 | A | | 5/1998 | Henly et al. | |
| 5,752,991 | A | | 5/1998 | Plavac | |
| 5,756,435 | A | | 5/1998 | Carey et al. | |
| 5,772,873 | A | | 6/1998 | Hudgens et al. | |
| 5,777,041 | A | | 7/1998 | Emert et al. | |
| 5,777,142 | A | | 7/1998 | Adams et al. | |
| 5,780,554 | A | | 7/1998 | Emert et al. | |
| 5,786,490 | A | | 7/1998 | Dietz et al. | |
| 5,803,024 | A | | 9/1998 | Brown | |
| 5,833,722 | A | | 11/1998 | Davies et al. | |
| 5,840,920 | A | | 11/1998 | Baker | |
| 5,856,524 | A | | 1/1999 | Dietz et al. | |

5,880,219 A 3/1999 Thaler et al.
5,897,770 A 4/1999 Hatch et al.
5,919,869 A 7/1999 Thaler et al.
5,948,248 A 9/1999 Brown
6,010,639 A 1/2000 Mitchell et al.
6,017,369 A 1/2000 Ahmed
6,020,500 A 2/2000 Baker et al.
6,074,445 A * 6/2000 Ahmed ..... 44/385
6,114,547 A 9/2000 Baker et al.
6,140,541 A 10/2000 Melder et al.
6,183,524 B1 * 2/2001 Ahmed ..... 44/385
6,238,554 B1 5/2001 Martin et al.
RE37,369 E 9/2001 Hudgens

* cited by examiner

CONTROLLED RELEASE ADDITIVES IN FUEL SYSTEMS

FIELD OF THE INVENTION

The present invention relates to devices and methods for providing supplemental chemical additives to fuel systems, for example, engine fuel systems, such as those of automobiles, trucks, heavy equipment, and the like, and fuel delivering and dispensing systems.

BACKGROUND OF THE INVENTION

Internal combustion engines are still the predominant means for propelling motorized vehicles. They are proven to offer many advantages over alternative mechanisms, among these being cost and convenience, however, they also present a number of increasingly concerning limitations. For instance, incomplete combustion of hydrocarbons remains a problem, leading to ozone production and air pollution. This can be countered somewhat by reducing engine tolerance and increasing the temperature of combustion, but doing so exerts an adverse impact on the materials of the engine. It then becomes desirable to add combustion enhancers, such as ferrocene, and friction inhibitors, and the like, to the fuel. Also, whenever fuel sits for an extended period of time or is exposed to air, thermal degradation products and bacterial slime can accumulate, which must be removed by the fuel line filter. A build-up of these undesirable products can be mitigated with the use of antioxidants and microbicides. Other performance-enhancing additives, e.g., for reducing pollution and/or increasing fuel efficiency, can also be added beneficially to the fuel.

Various methods of introducing additives to vehicle fluid systems, generally, have been proposed. Rohde U.S. Pat. No. 3,749,247 describes a container for releasing an oxidation inhibitor into hydrocarbon-based lubricating oil in a working engine. The oxidation inhibitor is held in a polyolefin container that permits the additive to permeate through the container wall into the oil. A further approach is described by Lefebvre U.S. Pat. No. 5,591,330, which discloses a hydrocarbon oil filter wherein oxidation additives in a thermoplastic material are mounted in a casing between a particle filtering material and a felt pad. Reportedly, the thermoplastic material dissolves in the presence of high temperature oil thereby releasing the additives. Additionally, an additive release device for use in an engine fuel line is proposed by Thunker et al U.S. Pat. No. 5,456,217. The latter device comprises a partially permeable cartridge positioned in the filling neck of the fuel tank so that whenever fuel is added, a portion of the additive contents of the cartridge is released into the tank. Furthermore, a fuel filter having integral means for releasing a fuel additive is proposed by Davis et al U.S. Pat. No. 5,507,942. This device attempts to prolong filter life while also providing a constant level of fuel additive by balancing exposure of the filter media to fuel and supporting the fuel additive in contact with the fuel.

The above-described devices suffer from a variety of limitations, such as unsuitability for fuel line systems, operating only when fuel is added to a tank, or insufficiently controlling delivery of additive to the fuel. It is an object of the present invention to provide an alternative, relatively low-cost device for releasing chemical additives into a fuel system at a constant rate, which requires minimal human intervention.

SUMMARY OF THE INVENTION

New apparatus and methods for providing release, preferably sustained release, of at least one additive into a fuel composition have been discovered. The present apparatus and methods effectively provide for sustained, preferably substantially controlled, release of additive into a fuel composition. The present apparatus and methods provide straightforward approaches to releasing the additive into fuel in vehicle fuel systems, as well as into fuel being delivered and dispensed.

Many components of the present apparatus, other than the additive or additives, are substantially insoluble in the fuel composition, so that these components remain intact and do not dissolve into and/or otherwise detrimentally affect the fuel and fuel system. In addition, several of the components of the present apparatus can be reused after the fuel additive has been spent, that is substantially completely released into the fuel. The present apparatus is easy and straightforward to manufacture cost effectively and can be used in fuel systems with little or no modification.

In one broad aspect, the present invention is directed to fuel additive containers for use in fuel systems, for example, associated with vehicles, fuel delivery or delivering systems, fuel dispensing systems and the like, which are designed to provide sustained or gradual, preferably substantially controlled, release of at least one additive(s) into a fuel composition. The present containers comprise a fuel-impermeable casing defining a substantially hollow interior and at least one opening. A fuel additive composition comprising at least one chemical additive soluble in fuel, for example, at least one fuel-soluble supplemental additive, is provided in the interior of the casing. The fuel additive may be provided in the form of a liquid, gel, paste, or in solid form. In one particularly useful embodiment of the invention, the fuel additive composition is provided as a plurality of particles, or in particulate form, for example, in the form of beads, tablets, pellets, grains or other particulate form.

The casing and other fuel-impermeable components of the apparatus of the present invention are preferably composed of materials selected from suitable metals, fuel-insoluble polymeric materials, combinations thereof and mixtures thereof. Useful casings can be made of materials selected from metals, such as steel, aluminum and the like, polyvinyl chloride, polyethylene, polypropylene, nylon, polyethylene vinyl acetate (EVA), polypropylene vinyl acetate (PVA), combinations thereof and mixtures thereof, and the like.

The containers of the present invention also include at least one fuel-permeable element or component which is provided at or near the at least one opening of the casing. This fuel-permeable element is effective to provide for At release of a portion of the chemical additive composition in the casing into a fuel composition, for example, a liquid fuel composition, such as a liquid hydrocarbon fuel composition, in contact with the casing. Such release occurs over a period of time so that a portion of the chemical additive is retained within the casing, at least after the initial release of additive occurs. The additive release obtained in accordance with the present invention preferably is sustained additive release.

In one embodiment of the invention, the casing is substantially cylindrical in shape. The casing includes at least one opening, for example, at an end of the casing or in a side wall of the casing, where fuel is allowed to contact a portion of the fuel additive composition contained within the casing. For example, an end cap can be employed which cradles or attaches to the open end and retains the fuel additive composition within the casing. In one embodiment of the invention, the cylindrical shaped casing includes two open ends, each open end being covered by an end cap. The end cap preferably comprises a fuel-impermeable material and is effective to retain the fuel additive composition within the casing. The end cap includes one or more inlets or openings for allowing fluid communication between fuel composition located exterior to the casing and the fuel additive composition within the casing to permit the release, for example, by diffusion or otherwise, of the chemical additive into the fuel composition, preferably at a substantially controlled rate.

In a more preferred embodiment, the casing is substantially bowl-shaped in form. The at least one opening may be located at any point of the casing, for example, on the top of the casing, in a side (side wall) of the casing and/or in the bottom of the casing. In one useful embodiment, particularly when the bowl-shaped casing has an open end, for example, an open top end, a cap member may be included which provides means for retaining the fuel additive composition within the casing interior. The cap member advantageously is made of polymeric material and includes at least one inlet or opening, and preferably a plurality of inlets or openings, for allowing contact between the fuel additive composition and the fuel composition. The cap member may be secured to an interior surface of the casing, and may be somewhat recessed therein. In one embodiment of the invention, the cap member is removably secured or removably sealed to the casing, for example, by means of an o-ring or other suitable, e.g., conventional, sealing element or assembly. In addition, a plate member may be provided and fixed within the bowl-shaped casing. The plate member includes one or more plate inlets which substantially align with the cap member inlets. The plate member may be made of any suitable fuel-insoluble material.

In one embodiment, the container of the present invention comprises the bowl-shaped casing having both the cap member and the plate member disposed across the container open end. A fuel-permeable element is disposed, or sandwiched, between the cap member and the plate member.

The fuel-permeable element(s) or component(s) may comprise any suitable fuel-permeable structure, and all such structures are included within the scope of the present invention. In one particularly useful embodiment, the fuel-permeable element or component comprises a filter member or filter media, for example, a porous or semi-permeable membrane.

The porous or semi-permeable membrane of the apparatus of the invention may be made of any suitable material that permits the desired, preferably sustained, release of chemical additive into the fuel, particularly when the casing is in contact with fuel. The membrane can be made of a fuel-insoluble material, for instance, having irregularly-sized channels or discrete-sized pores therein. As used herein, a "porous" membrane refers generally to membranes having pores in a substantially discrete size range, such as a wire screen or filter media, for example, filter paper and the like. As used herein, a "semi permeable" membrane refers to a continuous medium, which does not have pores in a discrete size range, but instead preferably permits diffusion of molecules through narrow channels, the size of which can be difficult to measure.

In one embodiment, the membrane, for example, the porous or semi-permeable membrane, comprises one or more glasses and/or one or more polymeric materials and/or one or more papers and/or the like, combinations thereof and mixtures thereof. Very useful membranes can be made of materials selected from nylon, cellulose acetate, cellulosic polymers, glasses, polyester, polyurethane, polyvinyl chloride, polyethylene vinyl acetate, polypropylene vinyl acetate, natural and synthetic rubbers, and the like, combinations thereof and mixtures thereof.

Alternatively or additionally, the fuel-permeable element (s) or component(s) can include a fuel-soluble material, such as in the form of a dissolvable, that is, fuel-dissolvable, seal, which dissolves, for example, gradually, in the presence of the fuel to effect release of the additive from the casing. The dissolvable seal may comprise, for example, a fuel-soluble polymer seal. Preferably, although not necessarily, the at least one fuel-permeable element includes a support structure, for example, a wire screen or cloth or other fuel-insoluble material, which may be coated with a fuel-soluble polymer to form a suitable seal structure. Alternatively, the dissolvable seal may comprise the fuel soluble polymer alone, without such a support structure. It is also noted that the membrane can be coated, e.g., with a polymeric material or a fuel insoluble polymeric material, such as a fuel-soluble polymeric material or a fuel-insoluble material, in order to more effectively control release of additive from the container into the fuel.

In another broad aspect, the invention is directed to methods for releasing a chemical additive, preferably at a sustained, more preferably substantially controlled, rate into a fuel composition, for example, a hydrocarbon based liquid fuel, including, but not limited to, diesel, gasoline, kerosene, jet fuel, biodiesel and synthetic hydrocarbon based liquid fuels such as those obtained in the Fisher-Tropsch process. Optionally, these hydrocarbon-based liquid fuels can contain additives other than those being released by the apparatus of the present invention. These additives include, but are not limited to, oxygenates, antioxidants, anti-wear additives, cetane improvers, corrosion inhibitors, demulsifiers, detergents/dispersants, flow improvers, lubricating agents, metal deactivators and the like and mixtures thereof. The present methods comprise placing a container as set forth herein in contact with a fuel composition. When the container is exposed to a fuel composition, the fuel passes through, for example, diffuses through, the fuel-permeable element or elements and contacts a portion of the fuel additive composition. Release, preferably sustained, substantially controlled release, of additive or additives into the fuel composition is obtained, for example, by diffusion through the fuel-permeable element.

In one useful embodiment, the container in accordance with the present invention at least partially replaces and/or is integrated into the center tube of a filter assembly used to filter fuel, for example, while the fuel is being used. Thus, the container is effective to provide additive release and as a structural member in a filter assembly.

Commonly assigned U.S. patent applications Ser. Nos. (Attorney Docket No. D-2874) and (Attorney Docket No. D2959CIP), filed on even date herewith, are directed to somewhat related subject matter. The disclosure of each of these co-pending U.S. applications is incorporated in its entirety herein by reference.

Each and every feature described herein, and each and every combination of two or more of such features, is included within the scope of the present invention provided that the features included in such a combination are not mutually inconsistent.

Additional aspects and advantages of the present invention are set forth in the following description and claims, particularly when considered in conjunction with the accompanying drawings in which like parts bear like reference numerals.

DETAILED DESCRIPTION OF THE INVENTION

Figure 1A:
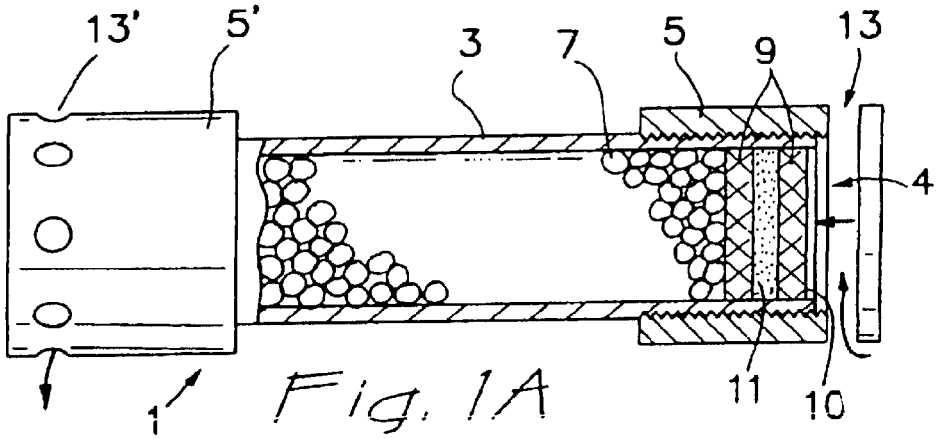
FIG. 1A is a partial cross-sectional view of a preferred cylindrical additive container wherein additive is released through both ends of the container in accordance with the present invention. In this embodiment, screw caps at either end of the container are provided with holes or openings.

The present invention is directed to containers for use in fuel systems, for example, vehicle fuel systems, fuel delivering systems, fuel dispensing systems and the like. Such containers are effective in gradually, over a prolonged period of time, releasing, for example, under sustained conditions, one or more chemical additives into fuel, preferably a liquid fuel and/or a hydrocarbon-based fuel composition, e.g., a hydrocarbon-based liquid fuel composition, including, but not limited to, diesel, gasoline, kerosene, jet fuel, biodiesel and synthetic hydrocarbon based liquid fuels such as those obtained in the Fisher-Tropsch process. Optionally, these hydrocarbon-based liquid fuels can contain additives other than those being released by the apparatus of the present invention. These additives include, but are not limited to, oxygenates, antioxidants, anti-wear additives, cetane improvers, corrosion inhibitors, demulsifiers, detergents/dispersants, flow improvers, lubricating agents, metal deactivators and the like and mixtures thereof.

Unless otherwise expressly noted to the contrary, each of the words "include", "includes", "included" and "including" and abbreviation "e.g." as used herein in referring to one or more things or actions means that the reference is not limited to the one or more things or actions specifically referred to.

The present containers comprise a casing, for example, a fuel-insoluble and fuel-impermeable casing, having or defining a substantially hollow interior. The casing has at least one opening. The casing may have any suitable shape and size, which are often chosen to be compatible with the particular application involved. The casing, for example, may have a generally cylindrical shape, a generally bowl shape or any of a large number of other shapes. The casing may have one or more curved and/or planar walls or it can have all curved or planar walls.

The at least one opening in the casing may be provided at any location or locations in the casing. For example, such opening or openings can be located at the top and/or bottom and/or ends and/or side or sides of the casing, as desired. The choice of the location for the opening or openings often is at least partially based on the particular application involved, and/or the ease and/or the cost of manufacturing the present additive containers and the like factors and may have at least some effect on the performance effectiveness of the containers.

In order to illustrate and describe the invention more clearly, cylindrically shaped casings and bowl-shaped casings are emphasized herein. However, the present invention is not limited thereto and is applicable to casings of other shapes. Containers including such other shaped casings are included within the scope of the present invention.

In one embodiment, the casing may be cylindrical in shape, for example, having a first end and a second end. The casing is provided with at least one opening, for example at one or both of the first end and second end and/or in the side wall of the casing. The casing may be substantially bowl-shaped. For example, the bowl-shaped casing defines a hollow interior, a top, bottom and one or more side walls. The opening or openings can be located in the top, bottom and/or one or more side walls.

A fuel additive composition, which comprises at least one fuel-soluble additive, is provided in the hollow interior of the casing. At least one fuel-permeable element is provided at or near at least one opening of the casing. For example, a fuel-permeable element advantageously is provided at or near each opening of the casing. Such fuel-permeable element or elements are effective to provide for release of a portion of the chemical additive composition into the fuel composition in contact with the casing, for example, in a sustained manner over time while retaining a balance of additive within the casing.

The casing of the container may be made of any suitable material or materials of construction. The casing as such has substantially no detrimental effect on the additive composition or the fuel composition or on the performance of the present container. The casing preferably is composed of a material selected from metals, such as steel, aluminum, metal alloys and the like, polymeric materials, combinations thereof and mixtures thereof. In one particularly useful embodiment, the casing is selected from metals, polyvinyl chloride (PVC), polyethylene (high density and/or low density), polypropylene (PP), nylon, polyethylene vinylacetate (EVA), polypropylene vinylacetate (PVA), polyester, acetal, polyphenylene sulfide (PPS), and the like, combinations thereof and mixtures thereof.

In one embodiment, the at least one fuel-permeable element or component of a present container, preferably comprising at least one fuel-permeable membrane, such as a porous or semi-permeable membrane, facilitates or permits contact of fuel composition with the chemical additive provided within the casing. The membrane may optionally be accompanied, when desired, by at least one membrane retention member or two or more retention members, for example, an open mesh screen, woven cloth and the like, effective in retaining the membrane in a substantially fixed position relative to, for example, within, the casing.

The fuel-permeable membrane of the invention is advantageously composed of a suitable fuel-insoluble material, preferably selected from polymeric materials, glasses, metals, combinations thereof and mixtures thereof. For example, suitable materials include, but are not limited to, glasses, nylon, cellulose acetate, polyester, polyethylene vinylacetate (EVA), polypropylene vinylacetate (PVA), polyvinyl chloride (PVC), cellulosic polymers, polyurethane, stainless steel mesh, sintered metal (such as sintered metal discs and the like), metal membrane filters (such as silver membrane filters and the like) and the like, as well as combinations thereof and mixtures thereof. The membrane can alternatively be a material through which a fuel additive can pass, for example, by diffusion (although not necessarily through pores), such as silicone rubber, polyethylene, polyvinylacetate, natural and synthetic rubbers, and other polymers and waxes, and combinations thereof and mixtures thereof. Such membranes are often referred to as semi-permeable membranes.

The fuel-permeable membrane of the present invention preferably comprises a porous membrane, advantageously a microporous membrane, such as those membranes having a pore size within the range of about 0.2 microns to about 100 microns, more preferably between about 5 and about 20 microns, for example, about 10 microns. As referred to herein, a "membrane" may be a single layer or may include multiple plies. The thickness of the membrane is preferably in a range of about 0.1 mm to about 0.5 mm or about 1 mm or about 5 mm, although other thicknesses can be effectively employed. Particularly useful membrane materials include materials useful as filter media, for example, in fuel filters. Examples of such materials include the filter medium sold by Fleetguard-Nelson under the trademark STRATOPORE and filter media available from Whatman and Millipore.

As noted above, in one embodiment, the fuel-permeable element further comprises at least one retention member. For example, the membrane may be retained across the opening of the casing by one or more wire or mesh screens, for example, stainless steel mesh screens. More particularly, the membrane may be sandwiched between at least two retention members. The retention members preferably are structured, for example, so as to have a mesh size to facilitate or permit chemical additive from the casing to be passed, for example, by diffusion, into the fuel composition in contact with the container. For instance, the retainer member or members preferably have a mesh size in the range of about 10 to about 300 microns or about 500 microns or more. A particularly preferred retention member is metal, e.g., stainless steel screening and/or woven cloth.

One or more components of the fuel-permeable member, may be at least partially soluble in the fuel composition, for example, hydrocarbon fuel, in contact with the container. For example, the fuel permeable element may include an at least partially fuel dissolvable seal or sealing element, for example, a wax (paraffin) seal. The sealing element(s) can be applied to an assembled membrane(s) and/or retention member(s) to form a sealed container, which can be effectively shipped and/or stored without the additive composition leaking from the casing and/or being exposed to the atmosphere. The seal(s) dissolve after the container or casing is exposed to fuel, for example, at elevated temperatures, thereby allowing the release of the chemical additive from the casing.

In one particularly advantageous embodiment, the sealing element includes a support structure, for example, a porous material, such as a wire screen, a woven cloth material and the like, coated, impregnated or otherwise associated with a fuel soluble polymer. For example, a preferred seal comprises such a wire screen or woven cloth support that has been impregnated or coated with molten fuel soluble polymer which is then allowed to cool and harden. Such a fuel soluble polymeric sealing material, for example, polyisobutylene wax, can be used as a sealing element without the support structure. In one embodiment, the support structure of the sealing element is a retention member for the membrane of the fuel-permeable element. The use of such a support structure/retention member is effective to facilitate sealing the container, for shipment and storage, and retaining the membrane in place during release of the additive from the casing.

Any suitable material or combinations of materials may be employed in the present at least partially fuel dissolvable seals, provided that such material or materials have no undue detrimental effect on the chemical additives, fuel compositions or the performance of the present containers. For example, the present seals may be selected from natural and/or synthetic waxes having a softening temperature of at least about 140° F. and which are soluble in the fuel composition to be treated. Representative materials from which the seals can be made include, without limitation, polyethylene waxes, polypropylene waxes, and polyisobutylene waxes, and the like and mixtures thereof. Such materials do not harm fuel quality and may actually enhance lubricity.

The fuel additive composition provided within a container of the invention comprises at least one chemical additive effective when released into the fuel composition to confer or maintain one or more benefits or beneficial properties to the fuel composition and/or the fuel system in which the fuel composition is used. The additive composition may be provided in the form of a liquid, gel, paste or solid particles, for example, beads, tablets, pellets or grains, and the like, as well as mixtures thereof, within the casing.

A fuel additive composition of the invention can advantageously further comprise a coating material that at least partially surrounds or encapsulates or coats the chemical additive, as discussed elsewhere herein. Such coating material may be provided in order to at least assist in controlling, or to control, the release of chemical additive from the casing, as desired. The coating material may be either fuel-soluble or fuel insoluble. The coating on the chemical additive should be such as to allow or permit at least some release of the additives from the casing into the fuel composition.

The fuel additive components of the present invention may be located in a matrix material, for example, a fuel-insoluble matrix material, such as a fuel insoluble polymeric material. The matrix material, if any, should be such as to allow or permit release of the additive component from the casing into the fuel. The matrix material advantageously is effective to at least assist in controlling, or to control, the release of the additive component into the fuel. In one embodiment, the additive component is present in the casing and no matrix material is employed.

In one embodiment, as discussed herein, the fuel-permeable element or elements include a polymer-containing membrane, for example, a polymer-coated membrane, in order to achieve enhanced additive release control. In this latter aspect, the membrane, that is the membrane of the fuel-permeable element or elements, is suitably coated, impregnated or otherwise associated, for example, by spray coating, dip coating and the like, with a polymer material. Suitable polymer materials include without limitation, fuel insoluble materials which have no significant detrimental effect on the fuel composition being treated, on the additive components in the casing or on the performance of the present container. Examples of such coating materials include those listed by Mitchell et al U.S. Pat. No. 6,010,639, the disclosure of which is incorporated in its entirety herein by reference. A particularly preferred polymer material is polyethylene vinyl acetate copolymer. In addition, or alternatively, the present retention member(s) of the fuel-permeable element or elements can be coated, impregnated, or otherwise associated with a material, for example, a fuel-insoluble polymer material, such as those disclosed in Mitchell et al U.S. Pat. No. 6,010,639, to at least assist in controlling or to control, release of the additive composition from the casing, as desired.

The container of the present invention preferably is filled with one or more fuel additives through the opening or openings of the casing or otherwise.

The containers of the invention, for example, the casings of the containers, may include one or more fuel-impermeable cap members or fuel-impermeable plugs, which can be detachable or removable from the casing or the remainder of the casing, for example, to facilitate filling the interior space of the casing with additive composition.

In one embodiment of the present invention wherein the casing is substantially cylindrical shaped and the opening or openings are located at the end or ends of the casing, one or both ends of the casing may include a cap member, with at least one of the cap members being removable to allow the casing or cartridge to be filled or refilled with fuel additive composition. Another open end of the casing, if desired, may include a cap member that is permanently sealed thereto, for example, during manufacture, for example, during injection molding of the container. Whenever the cap or plug is attached by threading or screwing it onto the casing, screw threads can be applied to the respective pieces during or after molding with suitable dies or within the mold. The cap member can alternatively be applied to the casing by a press fit. In this case, suitable tolerances to make a snap fit between the casing and the end piece can be provided, for example, to the plastic injection molds used to make the respective pieces. The end piece can also be formed integrally with the casing, e.g., during injection molding.

The cap or end piece used to close at least one end of the casing containing the chemical additive typically is provided with at least one opening to permit release of chemical additive therethrough, and to provide fluid communication between the fuel composition located exterior to the container and the fuel additive composition disposed within the casing interior. Whenever an end piece is formed integrally with the casing, the opening can be provided therein during or after formation of the casing, for example, by injection molding.

It will be appreciated by those of skill in the art that release of additive composition into a fuel system utilizing a container of the present invention is provided, and the release rate may be substantially controlled by consideration of several factors. The following factors, as well as others, may also have an effect on the performance and effectiveness of the containers of the present invention. For example, a desired fuel additive release rate may be obtained by appropriate selection of: the number and type membrane layers; membrane composition; membrane pore size, if any; the presence, type and amount, if any, of polymer associated with, e.g., coated, on the support member or membrane and/or retention member; and the presence, type and amount, if any, of the coating on the additive composition. The rate of release may also be influenced by the number and size of openings in the casing and the like. Other factors to be considered include, among others, the type and form of chemical additive in the fuel additive composition, solubility of the additive, fuel temperature, and velocity of fuel through the fuel line and the like factors.

Further contemplated within the invention is a method for releasing a chemical additive, preferably at a controlled rate, into a liquid fuel composition. The method comprises placing in contact with the fuel composition a container or cartridge as described herein containing the chemical additive component or composition. The container or cartridge configuration described herein preferably permits a release, preferably a controlled release, of additive component from the casing interior into the fuel composition. It is contemplated that, in some configurations, fuel composition is permitted to flow around and encircle the casing containing the chemical additive. However, even in these configurations, release of chemical additive is preferably sustained and/or controlled, for example, by passive diffusion, rather than by forced flow of fuel composition through the casing.

A chemical additive component for use in a container or cartridge of the invention preferably is provided as a liquid, gel, paste or as particles, for example, beads, tablets, pellets, grains, coated versions of these, and the like, as well as mixtures thereof. The particles have a physical size large enough to prevent passage through the fuel-permeable components of the invention as described elsewhere herein.

A chemical additive for use with the present invention serves some beneficial function within the fuel composition and/or fuel system. For instance, the fuel additive composition can include, but is not limited to, one or more dispersants/detergents, flow improvers, antioxidants, microbiocides, anti-foulants, anti-wear agents, lubricity agents, fuel stabilizers, emission reducing agents, demulsifiers, and the like and mixtures thereof.

As used herein, the term "additive" includes any material that can be compounded or admixed with the sustained release components to impart beneficial properties to the fuel composition. The present additive compositions may include, without being limited thereto, one or more of the additives set forth herein. For example, in a preferred embodiment, a dispersant/detergent is added to fuel to reduce the formation of varnishes.

A preferred dispersant is an amine acylated with a hydrocarbyl-carboxy acylating agent. U.S. Pat. Nos. 5,053,152; 5,160,648; 5,230,714; 5,296,154; and 5,368,615, the disclosure of each of which is incorporated in its entirety herein by reference, describe dispersants of this type prepared using amine condensates. Various other dispersants are available. For example, Henly et al U.S. Pat. No. 5,752,989, the disclosure of which is incorporated in its entirety herein by reference, disclose a dispersant comprising at least one member of the group consisting of polyalkylene succinimides and polyalkylene amines.

In another embodiment, the fuel additive compositions comprise a microbiocide compatible with combustion systems and fuels, which is more soluble in fuel than water. In another embodiment, a flow enhancer is added to the fuel. For example, fatty amides derived from succinic acid and phthalic acid are used as wax crystal growth inhibitors, as disclosed by Davies et al U.S. Pat. No. 5,833,722, the disclosure of which is incorporated in its entirety herein by reference. Also, a branched hydrocarbon mixture of about 1000 MW with copolymer of ethylene and unsaturated ether are used, as described by Feldman U.S. Pat. No. 3,790,359, the disclosure of which is incorporated in its entirety herein by reference. Alkyldiphenyl ether, as disclosed by Langer et al U.S. Pat. No. 3,999,960, the disclosure of which is incorporated in its entirety herein by reference, can also be used in this invention as a flow enhancer, for example, fuel wax crystal inhibitor.

Suitable antioxidants that can be added to fuel are metal dithiophosphates and metal dithiocarbonates. One particular anti-oxidant additive that has been found to be highly satisfactory and is preferred is a phenolic anti-oxidant, 4,4'-methylene-bis(2,6-di-tertbutylphenol), which is commercially available under the tradename ETHYL 702 (Ethyl Corporation).

Anti-wear agents, such as sulfur, metal naphthenates, phosphate esters and sulfurized hydrocarbons, etc., may also be used. One highly satisfactory and preferred EP additive, which is highly satisfactory as a bearing corrosion inhibitor is zinc dibutyldithio-carbamate, which is commercially available as BUTYL ZIMATE (R. T. Vanderbuilt Company).

Flow improvers, such as are disclosed by Feldman et al U.S. Pat. No. 5,094,666, the disclosure of which is incorporated in its entirety herein by reference, can be used. For example, such anti-gel and cold flow additives comprise copolymers of ethylene and vinyl esters of fatty acids with molecular weight of 500–50,000; or Tallow amine salt of phthalic anhydride, used at 0.005–0.2%; or Tallow amine salt of dithio-benzoic acid, used at 0.005–0.15%; or 4-hydroxy,3,5-di-t-butyl dithiobenzoic acid; or ethylene-vinyl acetate copolymers.

Dispersants/detergents, such as that disclosed by Herbstman U.S. Pat. No. 5,332,407, the disclosure of which is incorporated in its entirety by reference herein, can also be used. For example, in one embodiment, such dispersants/detergents include 4-alkyl-2-morpholine and alkylphenyl polyoxyalkylene amine.

Lubricating agents may also be used, for example, carboxylic acid polyol esters, dimer acid, polyol esters, castor oil, vegetable oils, fatty methyl esters (especially rapeseed), glycol esters, particularly oleates and linoleates (unsaturated). Lubricating agents, such as disclosed by Carey et al U.S. Pat. No. 5,756,435, the disclosure of which is incorporated in its entirety herein by reference, can be included. Examples of lubricating agents further include glycerol monooleate, or fatty formates, or fatty amides or 1,2-alkane diols.

Stabilizers, such as disclosed by Sweeney et al U.S. Pat. No. 4,460,379, the disclosure of which is incorporated in its entirety herein by reference, may be used. For example, such additive includes a hydrocarbyl polyoxypropylene di(polyoxyethylene) amine.

Emission (e.g., CO and nitrogen oxides) reducing agents, such as disclosed by Bowers et al U.S. Pat. No. 4,892,562, the disclosure of which is incorporated in its entirety herein by reference, may be used. For example, 0.01–1.0 ppm of fuel-soluble organometallic platinum compound in an oxygenated solvent such as octyl nitrate can be used as an emission reduction additive. Another example of emission additive includes dibenzyl cyclooctadiene platinum II in octyl nitrate. Cox U.S. Pat. No. 4,294,586 also discloses an emission reduction additive for use in diesel fuel. Such additive includes a mixture of alcohol, toluene, and hydrogen peroxide. Additionally, Vararu et al U.S. Pat. No. 4,857,073 discloses a composition comprising in admixture form about 6% of di-tertiary butyl peroxide, about 1% of tall oil imidazoline, about 0.5% of neo-decanoic acid and the balance being a hydrocarbon solvent carrier thoroughly mixed with the peroxide, imidazoline and acid. The disclosure of each of the above-noted Cox Patent and the Vararu et al Patent is incorporated in its entirety herein by reference.

Demulsifiers, such as that disclosed by O'Brien et al U.S. Pat. No. 4,125,382, the disclosure of which is incorporated in its entirety by reference herein, may be used. For example, such an additive includes polyoxyethylene ethers.

A device of the present invention can be placed in a fuel filter, either upstream or downstream of the filter medium, or it can be provided in a substantially fixed position in the fuel line, either upstream or downstream of a fuel filter. Release of an additive into the fuel is governed, at least in part, by pore size, membrane thickness, membrane composition, surface area of the membrane, viscosity of liquid additive, surface tension and membrane wetting ability of the additive, operating temperature and the like. The operating temperature of a fuel container of the present invention is typically between about −20° C. and about 50° C., thereby requiring any structural polymeric materials used in the present device to have a softening temperature greater than about 50° C. Such properties as viscosity and surface tension can be controlled further by the inclusion of thickeners, solubilizers, and surface active agents.

The invention will now be described with reference to certain examples, which illustrate but do not limit it.

EXAMPLES

Example 1

Dual Release Vessel

Referring now to FIG. 1A, container 1 comprises a solid, open ended, cylindrically shaped PVC casing 3 and end caps 5 and 5', which are screwed onto the casing. The casing 3 has two open ends 4. Provided within the casing are particles 7 of a fuel additive composition, which is retained within the casing by inner and outer screens 9 and fuel-permeable membrane 11. Wax seal 10 is applied to outer screen 9 for shipment/storage of the container. Alternately, or in addition, the wax seal can be applied to inner screen 9. If the seal is located on the top, the seal will come into contact with the fuel substantially immediately and effect a faster release of the additive composition. If the seal is located on the bottom, the fuel must first pass through the membrane in order to dissolve the wax. Such placement of the seal can be useful to delay the initial release of additive compositions, if such delay is desired. The wax seal dissolves whenever the container is placed in use. End caps 5 and 5' are provided with openings 13 and 13', respectively, which permit infiltration of fuel composition and contact with the porous membrane 11 in the casing 3. Moreover, release of fuel additive through the membrane 11 permits its incorporation into the fuel composition and its circulation throughout the fuel system. The arrows in FIG. 1A show the flow of fuel composition in and around the container 1.

Figure 1B:
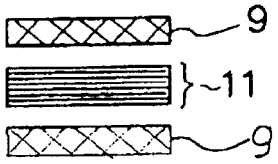
FIG. 1B is an exploded view of various components of the fuel-permeable element used in the container shown in FIG. 1A.

FIG. 1B is an exploded view of a preferred fuel-permeable element of the invention, which comprises mesh screens 9 on either side of fuel-permeable membrane 11. The screens 9 are sized and effective to hold membrane 11 in position in casing 3. Fuel-permeable member 11 is effective to allow fuel composition to contact particles 7 and to permit fuel additive to exit casing 3. The screens further assist membrane 11 to retain particles 7 within the casing 3.

For a container 1, six (6) inches in length having a 1.5 inch inner diameter, the amount of additive inside the casing is about 186 mL (173 g). Paraffin (wax) seal 10 may be applied to outer screen 9. A preferred wax has a melting point of 158° F. and dissolves in fuel over several hours at 100° F. Release of effective amounts of additive starts in less than about 24 hours.

Example 2

Single Release Vessel

Figure 2A:
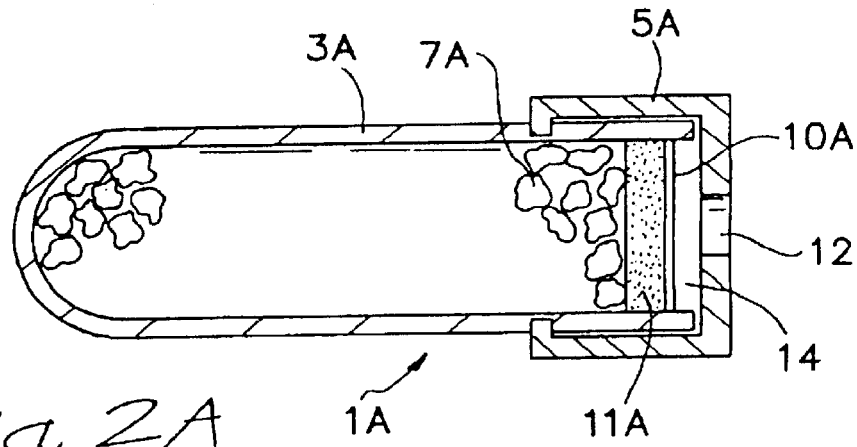
FIG. 2A is a cross-sectional view of an alternate cylindrical shaped additive container of the present invention, wherein a press-fit end cap is provided with an orifice that serves to control release of additive from the container.
Figure 2B:
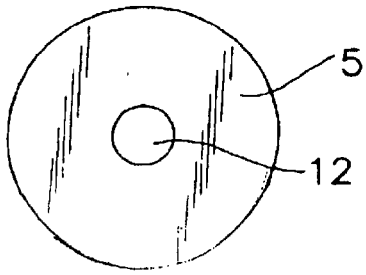
FIG. 2B is an end view of the end cap shown in FIG. 2A.

FIG. 2A depicts a cross-sectional view of an alternative embodiment of the present container, shown as 1A. In this embodiment, casing 3A is structured similarly to casing 3, but has only a single open end 14, which is capped with end cap 5A. The end cap 5A is press-fit onto casing 3A, rather than being screwed on, and is further provided with release orifice 12 that at least assists in controlling release of additive from the container 1. In this embodiment, membrane 11A is sufficiently rigid to hold it in place and retain particles 7A. Wax seal 10A is located in proximity to, preferably on, membrane 11A to seal container 1A for shipment/storage. FIG. 2B shows an end view of the end cap 5A shown in FIG. 2A, clearly showing orifice 12. Container 1A is effective, when placed in contact with fuel composition, to release additive composition from casing 3A into the fuel in a sustained manner over a period of time.

Example 3

Dual Release Configuration

Figure 3A:
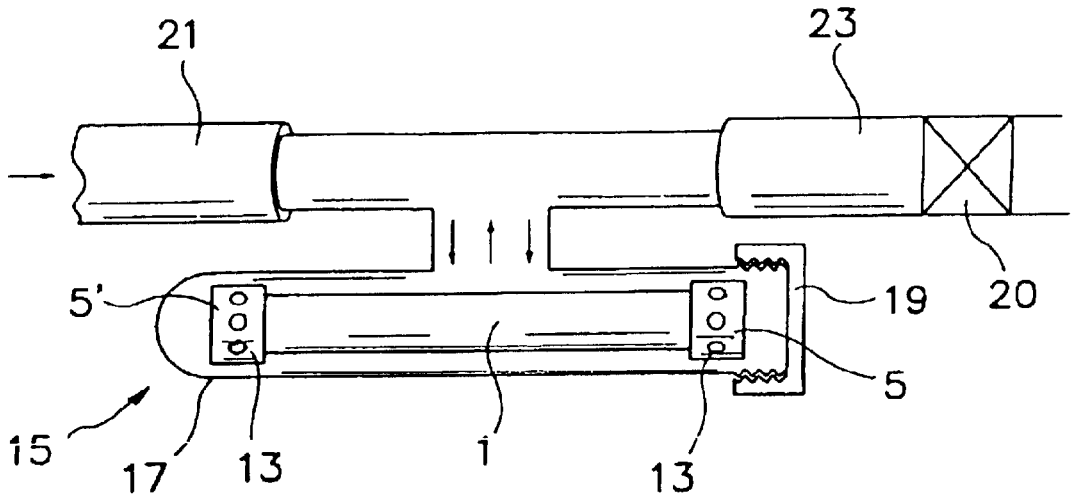
FIG. 3A is a schematic illustration showing the additive container of FIG. 1A in use in conjunction with an engine fuel line.

FIG. 3A illustrates one aspect of the present invention in which a dual-release container 1A (as shown in FIG. 1A) is employed in a "bypass" additive release vessel. In particular, container 1A lies horizontally in housing 15 and is held therein by screw cap 19, which is secured to housing body 17. Fuel flow from inlet line 21 enters housing 15 and exits via exit line 23. While inside the housing 15, fuel circulates through openings 13 and 13' in end caps 5 and 5', respectively, causing the release of additive from container 1A into the fuel. Generally, fuel flows into the housing 15 by the action of a fuel pump (not shown) of the fuel system, it being understood that gravity may also play a role. In addition, a fuel filter element 20, for example, of conventional and well known design, is located in exit or outlet line 23. It is understood that filter element 20 could alternatively be located in inlet line 21. Such alternative is included within the scope of the present invention.

Example 4

Single Release Configuration

Figure 3B:
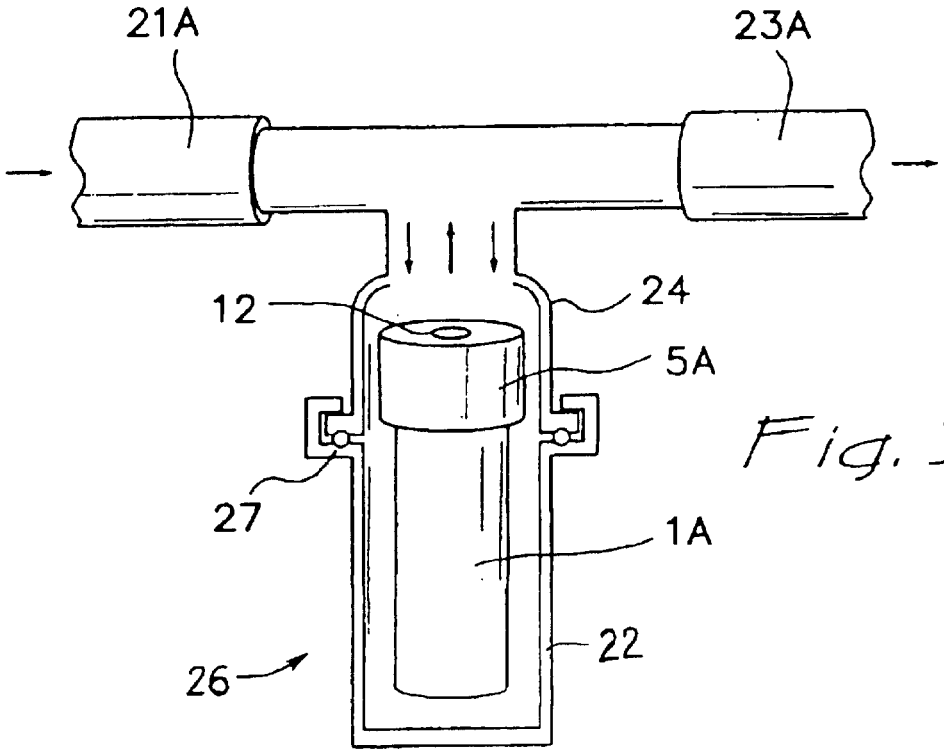
FIG. 3B is a schematic illustration showing the additive container of FIG. 2A in use in conjunction with a fuel system.

As shown in FIG. 3B, a further aspect of the invention has container 1A (as shown in FIG. 2A) positioned in a vertical alignment within housing 26 provided in a "bypass" configuration with the fuel system. Representative diameter for the orifice 12 is 0.75 inch for a container 1A that is 6 inches in length and has a 1.5 inch inner diameter. As shown, housing body 22 and housing top 24 interlock to secure the container within the housing 26. A housing O-ring seal 27 is provided between housing body 22 and housing top 24 to seal the interior space of housing 26. Fuel flow from inlet line 21A enters housing 26 and exits via exit line 23A. While inside housing 26, fuel passes in and out of orifice 12 causing the release of additive from the container 1A into the fuel. A fuel pump and a fuel filter element may be employed by this embodiment in a manner analogous to that described in Example 2.

Example 5

Bowl-shaped Configuration

Figure 4A:
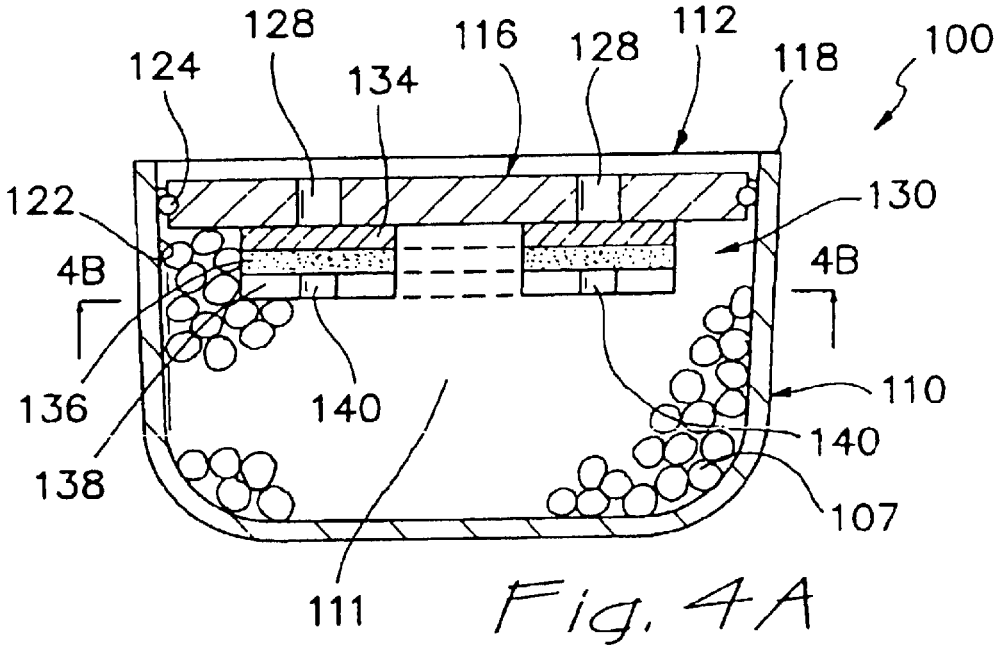
FIG. 4A is a cross-sectional view of an additional embodiment of an additive container in accordance with the present invention.
Figure 4B:
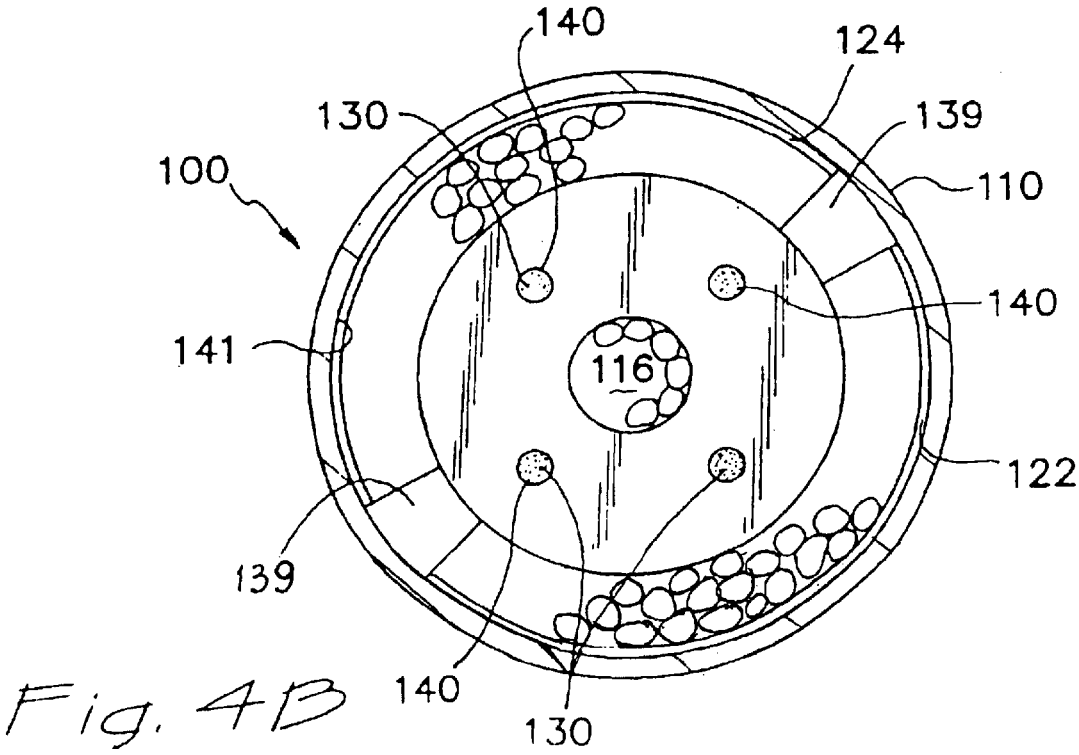
FIG. 4B is a view taken generally along the line of 4B—4B of FIG. 4A.

Turning now to FIGS. 4A and 4B, an additional container 100 of the present invention is shown. The container 100 generally comprises a bowl-shaped, fuel-impermeable casing 110 having an interior 111 filled with a fuel additive composition 107, and a relatively wide open top end 112 which is, for example, circular in shape. The container 100 further comprises a cap member 116 disposed across, and preferably substantially completely covering the open end 112.

The container 100 is useful in a fuel line, for example, of an internal combustion engine (not shown). The container is typically placed or secured in the fuel line, for example, in a manner analogous to that shown in FIGS. 3A and 3B.

Preferably, in the preferred container 100 shown, the cap member 116 is removably secured to the casing 110 in order to allow for filling and/or refilling of the container 100 with fuel additive composition 7. As shown, the cap member 116 may be recessed from a periphery, or rim 118, of the casing 110.

The cap member 116 may be secured to an interior surface 122 of the casing 110 by means of a resilient O-ring 124 or the like.

The cap member 116 includes at least one inlet 12B, preferably a plurality of inlets 128, to allow a liquid fuel composition (not shown) flowing exterior to the container 100 to enter the casing 110 and contact the fuel additive composition 107.

A fuel-permeable element 130 is provided for controlling release of fuel additive into the fuel. More specifically, the fuel permeable element includes a dissolvable seal layer 134, a membrane filter member layer 136 and a plate member 138 having one or more inlets 140 therethrough.

The dissolvable seal layer 134 preferably comprises a wire or mesh screen, for example a stainless steel screen, impregnated with a fuel-soluble polymer as described elsewhere herein. The layer 136 is a layer of filter medium, as described elsewhere herein.

The plate member 138 may be made of aluminum or other material or materials that are insoluble in hydrocarbon fuel. The plate member 138 is second in place in interior 111 using internally extending tabs 139 which are in fixed, abutting relation to the inner wall 141 of casing 110. As shown in FIG. 4A, the plate member inlets 140 generally align with the cap member inlets 128. Alternatively, the plate inlets 128 and the cap inlets 140 may be partially or entirely offset from one another. It will be appreciated that the size (and offset position if applicable) of the inlets 128, 140 will generally affect the rate of release of fuel additive into the fuel. In the shown embodiment, each of the seal layer 134, membrane layer 136 and plate member 138 are annular, or "donut" shaped.

As shown in FIG. 4A, the dissolvable seal layer 134 overlays the membrane layer 136, and both of these layers 134, 136 are sandwiched between the cap member 116 and the plate member 138. The seal layer 134 and the filter media layer 136 may alternatively comprise smaller, multiple elements that are sufficiently sized to at least shield the inlets 128, 140.

Container 100 functions in a manner substantially analogous to container 1A, and is effective to release additive from the container into the fuel. A fuel pump and a fuel filter element may be employed in this embodiment in a manner analogous to that described in Example 2.

Example 6

Alternative Bowl-shaped Configuration

Figure 5A:
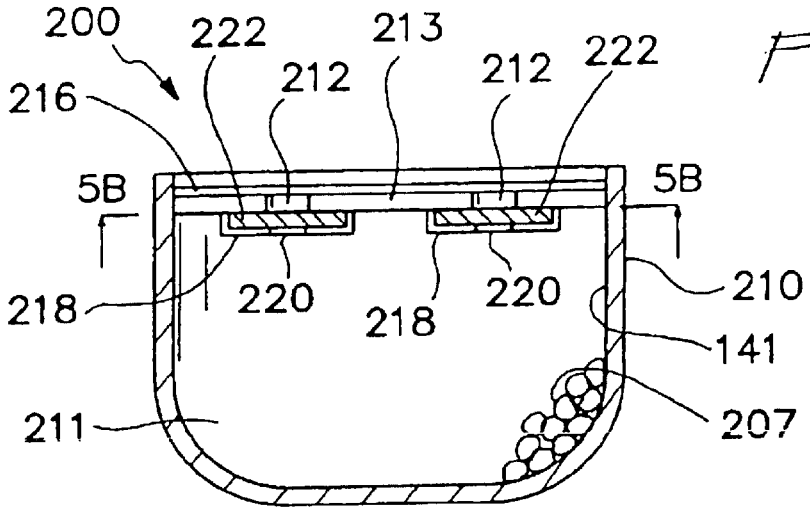
FIG. 5A is a cross-sectional view of another embodiment of an additive container in accordance with the present invention.
Figure 5B:
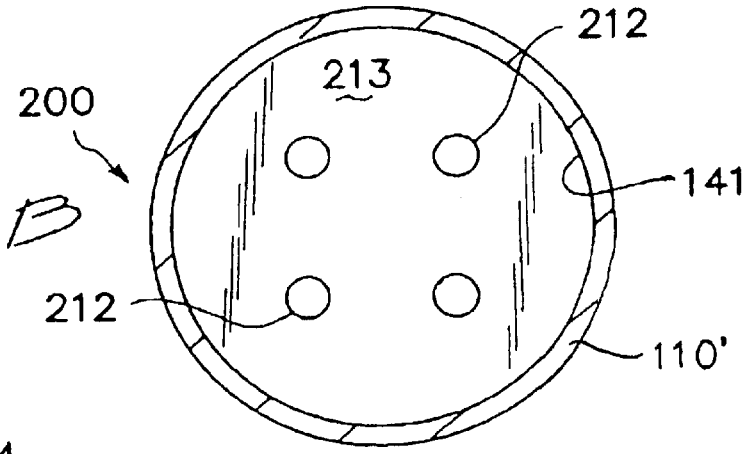
FIG. 5B is a view taken generally along the line of 5B—5B of FIG. 5A.

FIGS. 5A and 5B show still another container 200 of the present invention that is generally similar to the container 100 shown in FIGS. 4A and 4B. The container 200 generally comprises the bowl-shaped casing 210 defining a hollow interior 211 for containing fuel additive composition 207. In addition, an aluminum plate member 213 is secured to the inner wall 241 of casing 210 for retaining the fuel additive composition 207 within the casing 210. The aluminum plate member 213, including a plurality of inlets 212, for example, four inlets 212 as shown. Covering each of the plurality of inlets 212 is a dissolvable, fuel-soluble polymer seal 216.

Four individual support structures 218 are secured to plate member 213 directly below each of the inlets 212. Each of these structures 218 has an opening 220 and is sized to accommodate a membrane segment 222 between the plate member 213 and the opening 220.

Container 220 can be used in a manner analogous to container 100 and functions and is effective to release additive from the interior into the fuel. A fuel pump and a fuel filter element may be employed in this embodiment in a manner analogous to that described in Example 2.

Examples 7 and 8

Containers Including Differently Placed Openings

Figure 6:
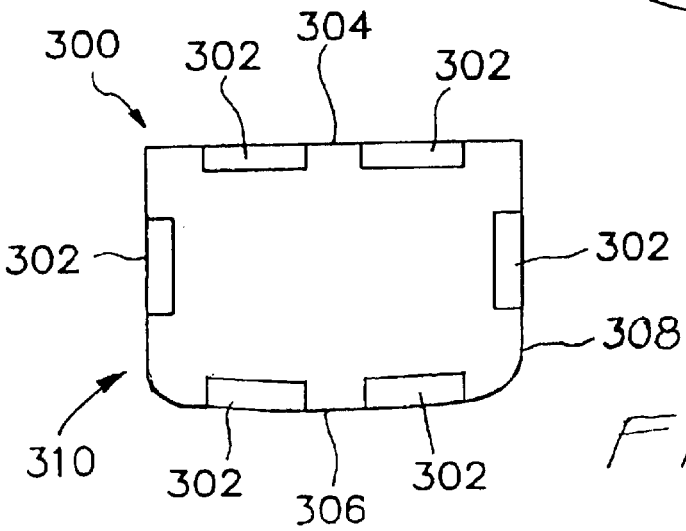
FIG. 6 is a schematic illustration of a further embodiment of a generally bowl-shaped additive container in accordance with the present invention.
Figure 7:
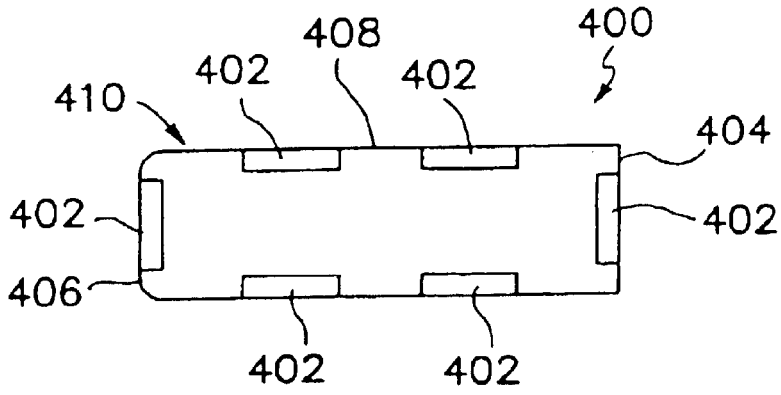
FIG. 7 is a schematic illustration of still another embodiment of a generally cylindrical shaped additive container in accordance with the present invention.

As noted elsewhere herein, containers which include openings and fuel-permeable elements at any location or locations on the casing of the containers are included within the scope of the present invention. For example, as shown in FIG. 6, a bowl-shaped container 300 can have one or more structures which include at least one opening and a fuel-permeable element, which structures are shown generally as 302, in the top 304 and/or bottom 306 and/or side wall 308 of the casing 310. Also, as shown in FIG. 7, He a cylindrical shaped container 400 can have one or more structures which include at least one opening and a fuel-permeable element, which structures are shown generally as 402, in the first end 404 and/or second end 406 and/or side wall 408 of the casing 410.

Each of the structures 302 and 402 include an opening in the casing 310 and 410, respectively; a seal layer, effective for shipment/storage; and a membrane layer effective in controlling the release of the additive in the casing into the fuel. The structure or structure 302 and 402 are secured to the casings 310 and 410, respectively, using techniques analogous to those described herein to secure fuel-permeable elements to casings. Such analogous techniques are well within the ordinary skill in the art and need not be described in detail here.

Containers 300 and 400 can be used in manners analogous to those described herein with respect to containers 1, 1A, 100 and 200, and are effective to release additive from the container into the fuel. A fuel pump and a fuel filter element may be employed in this embodiment in a manner analogous to that described in Example 2.

Example 9

Filer Assemblies Including Additive Containers

Figure 8:
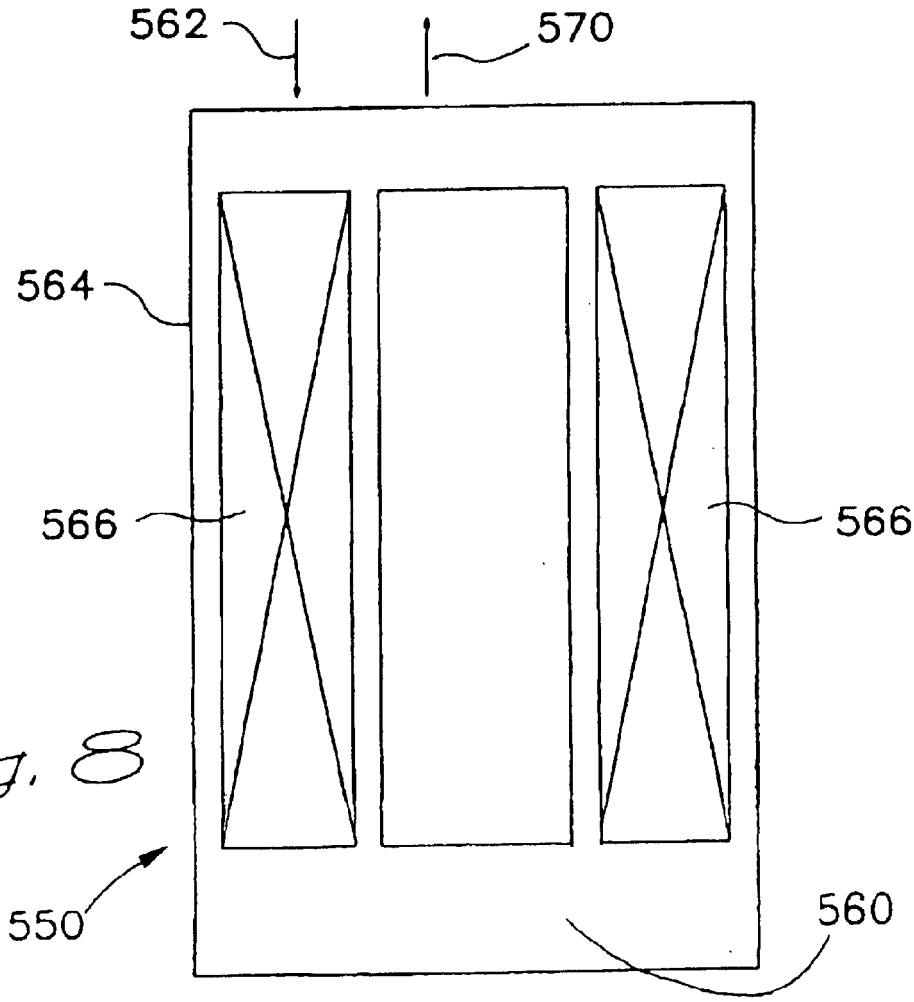
FIG. 8 is a schematic illustration of a fuel filter assembly including an additive container.

FIG. 8 schematically illustrates a fuel filter assembly 550 in which an additive container 560 in accordance with the present invention is employed is the center tube. The container 560 is cyclindrically shaped and is configured generally analogously to many of the containers described elsewhere herein.

Fuel from inlet line 562 passes into filter housing 564 and comes into contact with filter medium 566, of conventional structure. The filtered fuel is then contacted with container 560 and additive from the container is released into the fuel. The filtered, additive enriched fuel then passes from the filter housing 554 through outlet line 570 and ready for use in fuel system service.

It should be noted that the filter assembly can be configured so that the fuel contacts the additive container first, before contacting the filter medium, and such alternate configuration is within the scope of the present invention.

In any event, the additive container 550 acts and is effective both to provide for sustained release of additive and as a structural member for the filter assembly 550.

While the present invention has been described with respect of various specific examples and embodiments, it is to be understood that the invention is not limited thereto and that it can be variously practiced within the scope of the following claims.

What is claimed is:

1. A container for releasing a chemical additive in a liquid fuel composition comprising:

a casing defining a fuel-impermeable wall structure, a substantially hollow interior and at least one opening in the wall structure;

a fuel additive composition provided in the interior of said casing, said fuel additive composition comprising a chemical additive soluble in a liquid fuel composition; and at least one fuel-permeable element provided at or substantially directly adjacent the at least one opening of the casing and structured to be effective to provide for release of a portion of the chemical additive into the liquid fuel composition when the liquid fuel composition is in contact with the casing, the element comprising at least two different types of components, the types of components being selected from the group consisting of (1) a porous member, (2) a semi-permeable member, and (3) an at least partially fuel-soluble seal, provided that each of the components initially extends substantially across the at least one opening.

2. The container of claim 1 wherein the casing comprises a material selected from the group consisting of metals, polymeric materials, combinations thereof and mixtures thereof.

3. The container of claim 2 wherein the material is selected from the group consisting of metals, polyvinyl chloride, polyethylene, polypropylene, nylon, polyethylene vinyl acetate, polypropylene vinyl acetate, combinations thereof and mixtures thereof.

4. The container of claim 1 wherein the casing is a substantially cylindrical-shaped casing.

5. The container of claim 4 wherein the at least one opening comprises at least one open end of the cylindrical-shaped casing or at least one side opening in a sidewall of the cylindrical-shaped casing.

6. The container of claim 1 wherein the casing is a substantially bowl-shaped casing.

7. The container of claim 6 further comprising a cap member disposed across a top of the substantially bowl-shaped casing.

8. The container of claim 6 wherein the at least one opening is located in a top of the substantially bowl-shaped casing, in a side of the substantially bowl-shaped casing or in a bottom of the substantially bowl-shaped casing.

9. The container of claim 1 wherein the at least one fuel-permeable element comprises the at least partially fuel soluble seal.

10. The container of claim 9 wherein the at least partially fuel-soluble seal comprises a support structure structured to support the at least partially fuel soluble seal, the support structure being coated with a fuel soluble polymer.

11. The container of claim 10 wherein the support structure comprises a wire screen, a woven cloth or combinations thereof.

12. The container of claim 1 wherein the at least one fuel-permeable element includes the semi-permeable member.

13. The container of claim 1 wherein the at least one fuel-permeable element includes the porous member.

14. The container of claim 13 wherein the at least one fuel-permeable element further includes an at least one retention member effective in retaining the porous member in a substantially fixed position relative to the casing.

15. The container of claim 13 wherein the porous member is a microporous membrane having a pore size of between about 0.2 microns to about 100 microns.

16. The container of claim 13 wherein the porous member comprises a material selected from the group consisting of metals, glasses, polymeric materials, combinations thereof and mixtures thereof.

17. A container for releasing a chemical additive in a liquid fuel composition comprising:

a casing defining a fuel-impermeable wall structure, a substantially hollow interior and at least one opening in the wall structure;

a fuel additive composition provided in the interior of said casing, said fuel additive composition comprising a chemical additive soluble in a liquid fuel;

a fuel-permeable element provided at or substantially directly adjacent the at least one opening of the casing and structured to be effective to provide for release of the chemical additive into the liquid fuel when the liquid fuel is in contact with the casing; and an at least partially fuel-soluble seal positioned so that the seal initially extends substantially across the at least one opening.

18. The container of claim 12 wherein the semi-permeable membrane comprises a material selected from the group consisting of metals, glasses, polymeric materials, papers, combinations the thereof and mixtures thereof.

19. The container of claim 1 wherein the at least one opening comprises a plurality of openings and the at least one fuel-permeable element comprises a corresponding plurality of fuel-permeable elements.

20. The container of claim 1 wherein the fuel additive composition is provided in a particulate form.

21. The container of claim 1 wherein the fuel additive composition is present in the casing in a liquid form.

22. The container of claim 1 wherein the chemical additive is selected from the group consisting of dispersants/detergents, antioxidants, anti-wear agents, corrosion inhibitors, demulsifiers, flow improvers, lubricating agents, microbiocides and mixtures thereof.

23. The container of claim 1 wherein the at least one fuel-permeable element is at least partially coated with a coating polymeric material.

24. A container for releasing a chemical additive in a liquid fuel comprising:

a casing defining a fuel-impermeable outer wall structure, a substantially hollow interior and at least two spaced apart openings in the outer wall structure;

a fuel additive composition provided in the interior of said casing, the fuel additive composition comprising a chemical additive soluble in a liquid fuel; and fuel-permeable elements, each of the fuel-permeable elements is provided at or substantially directly adjacent a different one of the at least two openings of the casing, each of the fuel-permeable elements being structured to be effective in controlling release of the chemical additive into the liquid fuel in contact with the casing.

25. The container of claim 24 wherein the casing comprises a material selected from the group consisting of metals, polymeric materials, combinations thereof and mixtures thereof.

26. A method for releasing a chemical additive at a sustained rate into a fuel composition comprising placing the container of claim 1 in contact with the fuel composition.

27. A method for releasing a chemical additive at a sustained rate into a fuel composition comprising placing the container of claim 4 in contact with the fuel composition.

28. A method for releasing a chemical additive at a sustained rate into a fuel composition comprising placing the container of claim 6 in contact with the fuel composition.

29. A method for releasing a chemical additive at a sustained rate into a fuel composition comprising placing the container of claim 9 in contact with the fuel composition.

30. A method for releasing a chemical additive at a sustained rate into a fuel composition comprising placing the container of claim 13 in contact with the fuel composition.

31. A method for releasing a chemical additive at a sustained rate into a fuel composition comprising placing the container of claim 12 in contact with the fuel composition.

32. A seal assembly comprising:

a fuel-permeable membrane sized and structured to be positioned in or substantially directly adjacent an opening in a casing defining a hollow interior containing a fuel additive soluble in a fuel composition, the membrane is structured to be positioned so that substantially all of the additive leaving the hollow interior through the opening passes through the membrane, and an at least partially fuel-soluble seal member sized and structured to be positioned relative to the opening in the casing to prevent additive leaving the hollow interior through the opening when the seal member is intact.

33. The seal assembly of claim 32 wherein the seal member is structured to be compromised in the presence of the fuel composition, thereby allowing additive to leave the hollow interior through the opening.

34. The container of claim 24 wherein the casing is a substantially cylindrical-shaped casing or a substantially bowl shaped casing.

35. The seal assembly of claim 32 wherein the seal member comprises a support structure and a fuel-soluble polymer.

36. The seal assembly of claim 35 wherein the support structure includes at least one of a wire screen and a woven cloth.

37. The seal assembly of claim 32 which further comprises at least one retention member sized and adapted to be positioned to be effective in retaining the membrane in a substantially fixed position relative to the casing.

38. The container of claim 24 wherein each of the fuel permeable elements comprise at least two different types of components, the types of components being selected from the group consisting of (1) a porous member, (2) a semi-permeable member, and (3) an at least partially coolant-soluble seal.

39. A method for releasing a chemical additive at a sustained rate into a fuel composition comprising placing the container of claim 24 in contact with the fuel composition.

40. A method for releasing a chemical additive at a sustained rate into a fuel composition comprising placing the container of claim 17 in contact with the fuel composition.

41. The container of claim 17 wherein the fuel-permeable element includes a porous member.

42. The container of claim 17 wherein the casing comprises a material selected from the group consisting of metals, polymeric materials, combinations thereof and mixtures thereof.

43. The container of claim 17 wherein the casing is a substantially cylindrical-shaped casing or a substantially bowl-shaped casing.

44. The container of claim 17 wherein the at least partially fuel soluble seal comprises a support structure structured to support the at least partially fuel soluble seal, the support structure being coated with a fuel soluble polymer.

45. The container of claim 17 wherein the support structure comprises a wire screen, a woven cloth or combinations thereof.

46. The container of claim 17 wherein the fuel-permeable element includes a semi-permeable member.

* * * * *